US006394375B1

(12) United States Patent
Balvanz et al.

(10) Patent No.: US 6,394,375 B1
(45) Date of Patent: May 28, 2002

(54) ROTATABLE HAMMER INSERT WITH BULLET TIP

(75) Inventors: Loran Balvanz; Paul Gray, both of New Providence, IA (US)

(73) Assignee: US Manufacturing, New Providence, IA (US)

( * ) Notice: Subject to any disclaimer, the term of this patent is extended or adjusted under 35 U.S.C. 154(b) by 0 days.

(21) Appl. No.: 09/550,812

(22) Filed: Apr. 18, 2000

(51) Int. Cl.[7] ..... B02C 13/28

(52) U.S. Cl. ..... 241/197; 241/294

(58) Field of Search ..... 241/195, 196, 241/197, 189.1, 294

(56) References Cited

U.S. PATENT DOCUMENTS 5,611,496 A * 3/1997 Fleenor ..... 241/197
6,059,210 A * 5/2000 Smith ..... 241/197
6,131,838 A * 10/2000 Balvanz et al. ..... 241/197

* cited by examiner

*Primary Examiner*—Mark Rosenbaum
(74) *Attorney, Agent, or Firm*—Daniel A. Rosenberg; Kent. A. Herink; Davis Brown Law Firm

(57) ABSTRACT

The present invention embodies an insert for attachment to a hammer of a size reducing machine for use in size reducing waste material, comprising a body with a centrally located mounting hole to allow for attachment of the insert to the hammer. The body also includes a bullet shaped tip distally located in relation to the body, wherein the tip can size reduce waste material on impact.

8 Claims, 8 Drawing Sheets

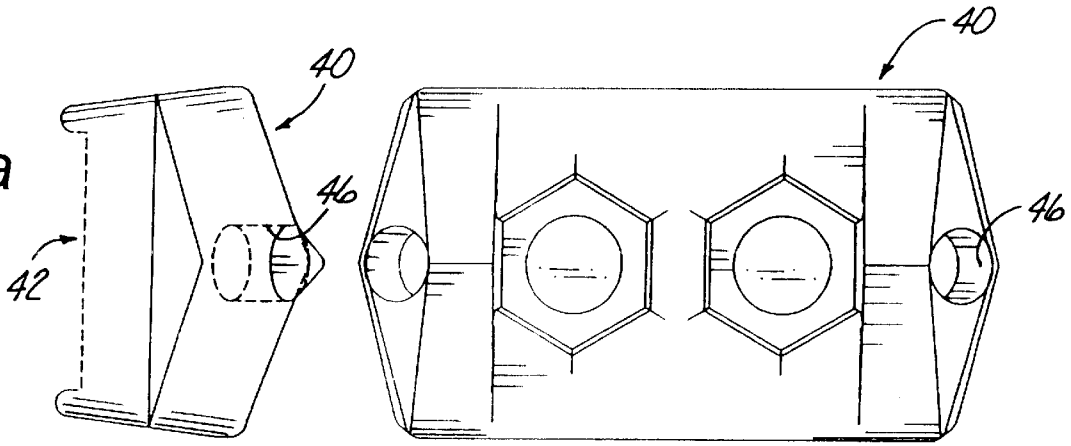
Fig. 4a
Fig. 4b
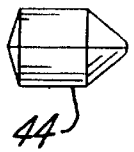
Fig. 4d
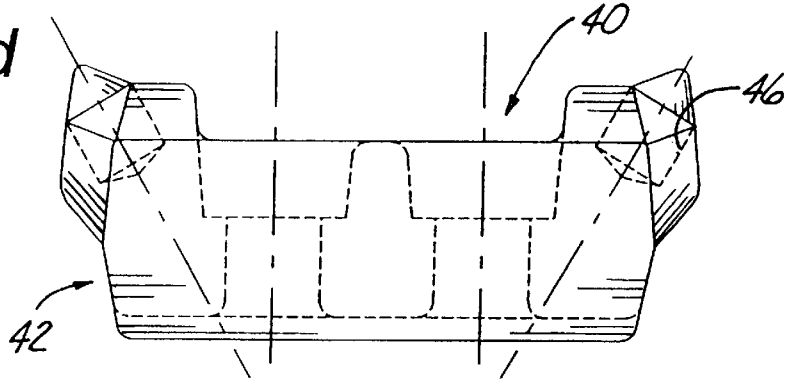
Fig. 4c

ROTATABLE HAMMER INSERT WITH BULLET TIP

BACKGROUND OF THE INVENTION

The present invention relates to a hammer insert with a bullet shaped tip. In particular, to a hammer insert for securement to a hammer of a size reducing machine, with a distally located bullet tip.x Prior art asphalt and concrete stripping machines have used bullet shaped inserts or tips for size reduction. This design typically incorporates a pointed cone or partially specially shaped tip joined to a round threaded end for removable attachment to the stripping machine. The tip presents a sharp pointed end that impacts the surface of the material being size reduced. The tip requires removal and replacement when worn from repeated impact. This requires frequently stopping operation of the size reducing machine to complete the maintenance work.

Additionally, the conventional bullet tip design provides little contact area for mounting the insert to a hammer. This makes the prior art bullet tip inserts susceptible to loosening during operation. A loose insert can dislodge during operation causing damage to the machine, and this represents a dangerous operating condition.

Furthermore, the prior art bullet tip design cannot be used with other types of standard size reducing machines, like tub grinders, rotary hammermills, and other machines that use the traditional rotatable bolt-on insert design. The difference between the bullet tip and bolt-on inserts requires the use of different methods of attachment, which make the inserts non-interchangeable.

Accordingly, a need exists for a bullet tip insert that allows for use with a wider range of size reducing machines.

SUMMARY OF THE INVENTION

An object of the present invention comprises providing an insert for attachment to a hammer of a size reducing machine for use in size reducing waste material.

These and other objects of the present invention will become apparent to those skilled in the art upon reference to the following specification, drawings, and claims.

The present invention intends to overcome the difficulties encountered heretofore. To that end, the present invention embodies an insert for attachment to a hammer of a size reducing machine for use in size reducing waste material, comprising a body with a centrally located mounting hole to allow for attachment of the insert to the hammer. The body also includes a bullet shaped tip distally located in relation to the body, wherein the tip can size reduce waste material on impact.

BRIEF DESCRIPTION OF THE DRAWINGS

FIG. 4*a* is an end view of an insert.

FIG. 4*b* is a top view of the insert of FIG. 4*a* with the tips removed.

FIG. 4*c* is a side view of the insert of FIG. 4*a*.

FIG. 4*d* is a side view of a bullet tip.

DETAILED DESCRIPTION OF THE INVENTION

Figure 1:
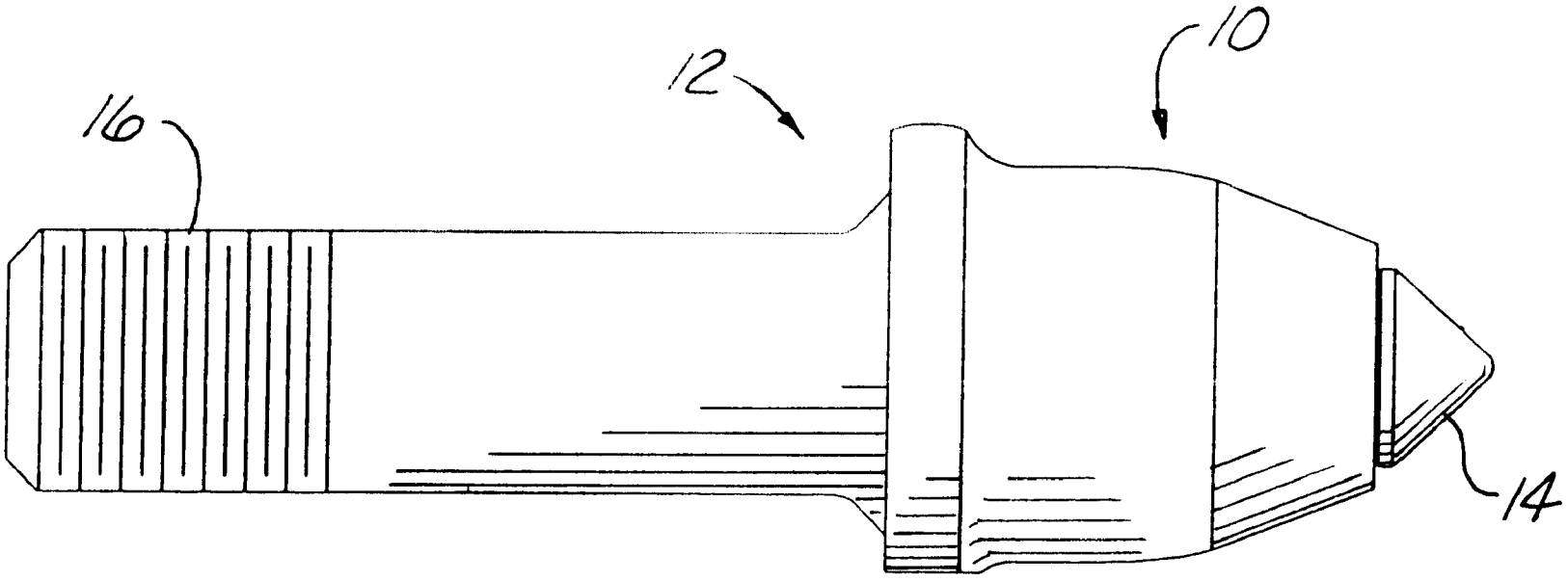
Fig. 1 (PRIOR ART)
FIG. 1 is a side view of a prior art bullet tip insert.

In the Figures, FIG. 1 shows a prior art bullet tip insert 10. The insert 10 includes a body 12 with a bullet tip 14 at one end and threads 16 at the other end. The bullet tip 14 is typically made of solid carbide. The threads 16 allow for releasable securement to the body of a hammer (not shown) of a size reducing machine (not shown). The prior art bullet tip insert 10, as mentioned previously, is designed for use with asphalt and concrete stripping machines. And, the insert 10 adapts for use with fixed or swing hammer machines. The body 12 of the insert 10 provides little surface area for attachment, and as a result is subject coming lose or detaching during operation.

Figure 2:
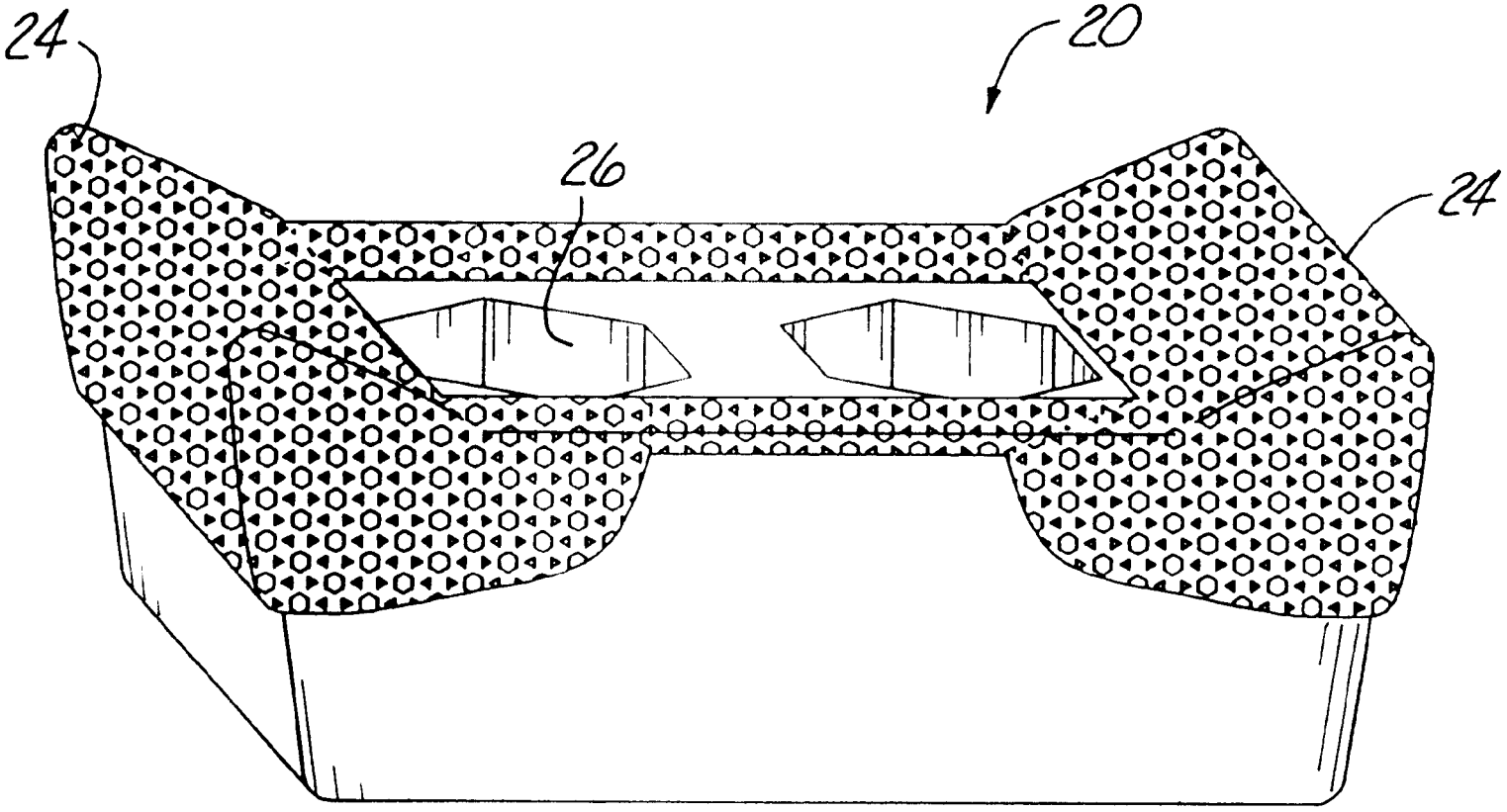
Fig. 2 (PRIOR ART)
FIG. 2 is a side view of a prior art bolt-on insert.

FIG. 2 shows a prior art standard two-bolt replaceable insert 20. The insert 20 includes a generally rectangular body 22 and one or more tips 24. The upper portion of the body 22 of the insert 20 typically includes a wear resistance coating (FIG. 2 - shaded region), like tungsten carbide. The wear resistance coating provides protection for the surfaces of the insert 20 that come into direct contact with debris during operation. The insert 20 also includes one or more bolt holes 26 to allow for attachment of the insert 20 to a hammer. As can be seen the insert 20 and the insert 10 embody different, and incompatible, designs for hammer attachment.

FIGS. 3*a–d* shows an insert 30 of the present invention. The insert 30 includes a body 32 similar in design and shape to the body 22 of the prior art insert 20. The insert 30 also includes one or more bullet tips 34 similar in design and shape to the bullet tip 12 of prior art insert 10. The insert 30 utilizes bolt holes 36 to releasably attach the insert 30 to a hammer. The body 32 of the insert 30 allows for wide variety of arrangements for the placement of the bullet tips 34. In each case the bullet tips 34 are distally located toward at least one edge of the body 32 of the insert 30. In FIG. 3, the bullet tips 34 are located distally and off center with respect to the body 32 of the insert 30.

FIG. 4*c* shows an insert 40 with a body 42 and two bullet tips 44. The insert 40 also includes tip holes 46 (see FIG. 4*b*), to allow for insertion of bullet tips 44 (see FIG. 4*d*).The bullet tips 44 are distally located and centered with respect to the body 42 of the insert 40. In the preferred embodiment of the invention the bullet tips 44 are silver soldered or welded in place within the tip holes 46.

Figures 5A, 5B, 5C, 5D, 5E, 5F:
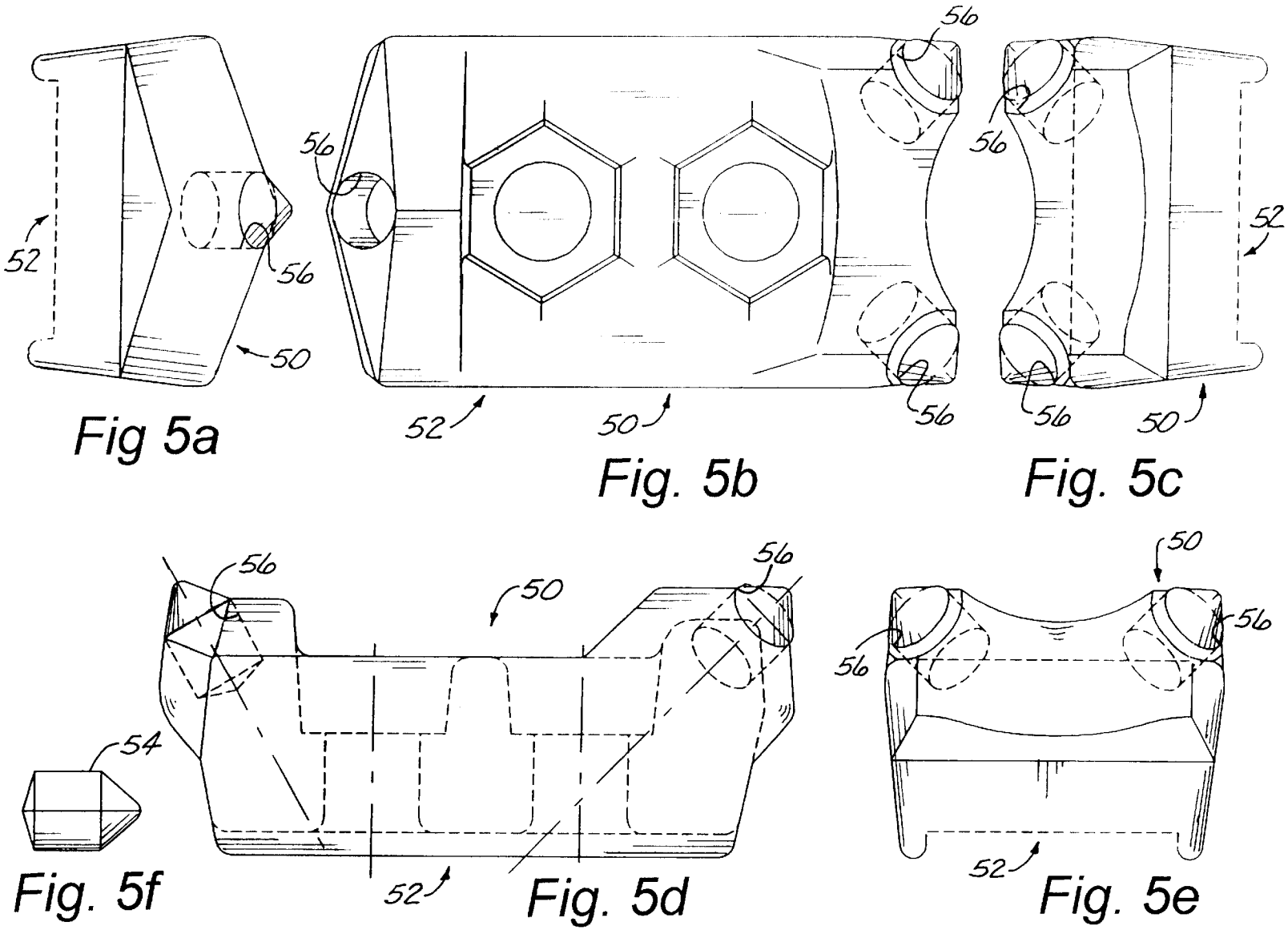
FIG. 5*a* is an end view of an insert.
FIG. 5*b* is a top view of the insert of FIG. 5*a* with the tips removed.
FIG. 5*c* is an end view of the insert of FIG. 5*a* with the tips removed.
FIG. 5*d* is a side view of the insert of FIG. 5*a* with the tips removed.
FIG. 5*e* is an end view of the insert of FIG. 5*a*, rotated 90° from the end view shown in FIG. 5*c* with the tips removed.
FIG. 5*f* is a side view of a bullet tip.
Figure 6B:
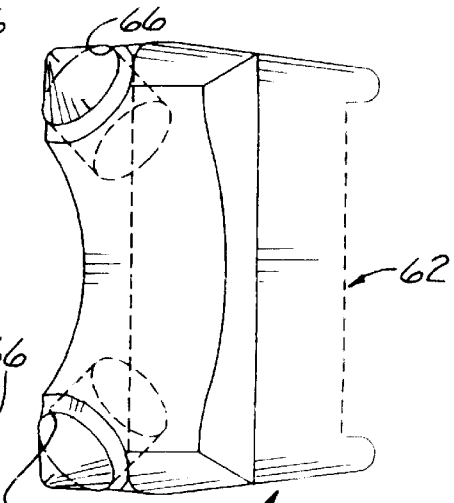
FIG. 6*b* is an end view of the insert of FIG. 6*a* with the tips removed.
Figure 6A:
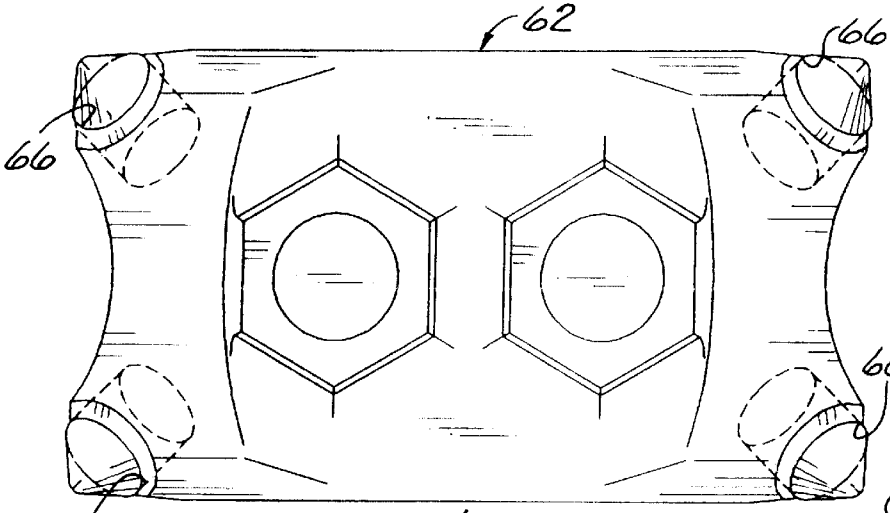
FIG. 6*a* is a top view of an insert with the tips removed.
Figure 6C:
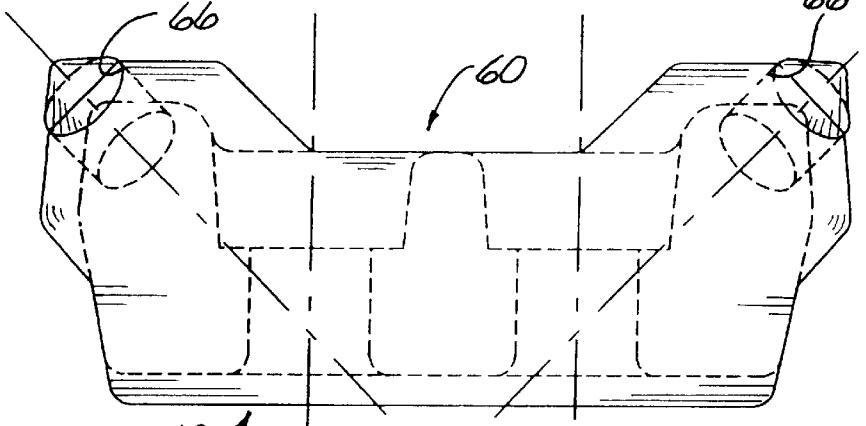
FIG. 6*c* is a side view of the insert of FIG. 6*a* with the tips removed.
Figure 6D:
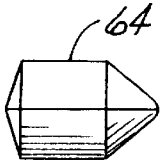
FIG. 6*d* is a side view of a bullet tip.

FIG. 5 and FIG. 6 show additionally options for location of the bullet tips. In particular, FIGS. 5*a–f* shows an insert 50 with a body 52 and three distally located tips holes 56 for use with three bullet tips 54. One end of the body 52 includes two bullet tips 54, while the other end of the body 52 includes one centrally located tip 54. FIGS. 6*a–d*, shows an insert 60 with a body 62 and four distally located tip holes 66 to allow for the use of four bullet tips 64.

Figure 3B:
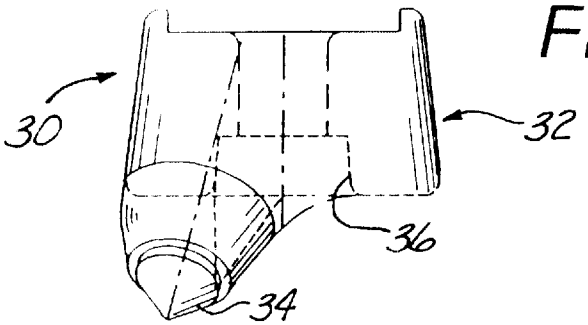
FIG. 3*b* is an end view of the insert of FIG. 3*a*.
Figure 3C:
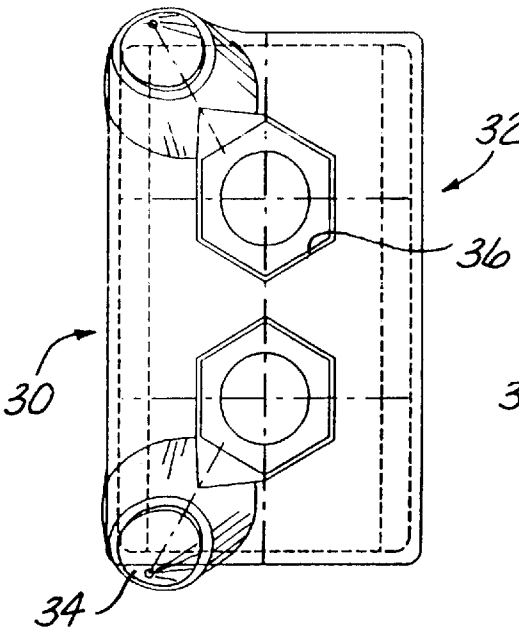
FIG. 3*c* is top view of the insert of FIG. 3*a*.
Figure 3D:
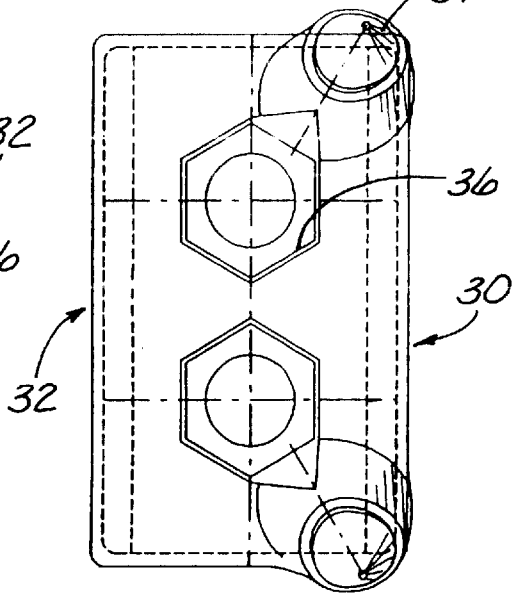
FIG. 3*d* is a top view of the insert of FIG. 3*a*, turned 180° from the top view shown in FIG. 3*c*.
Figure 3A:
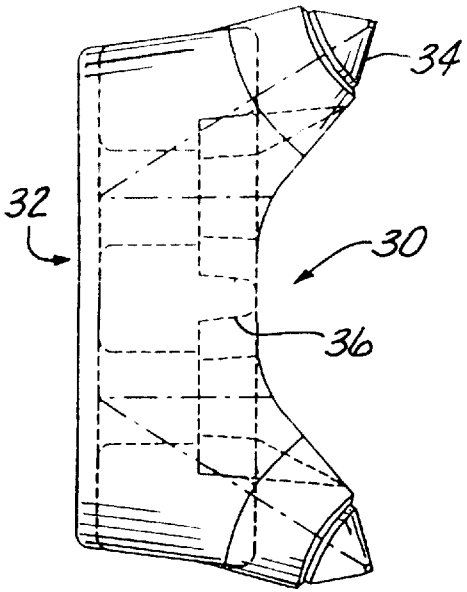
FIG. 3*a* is a side view of an insert.
Figure 7B:
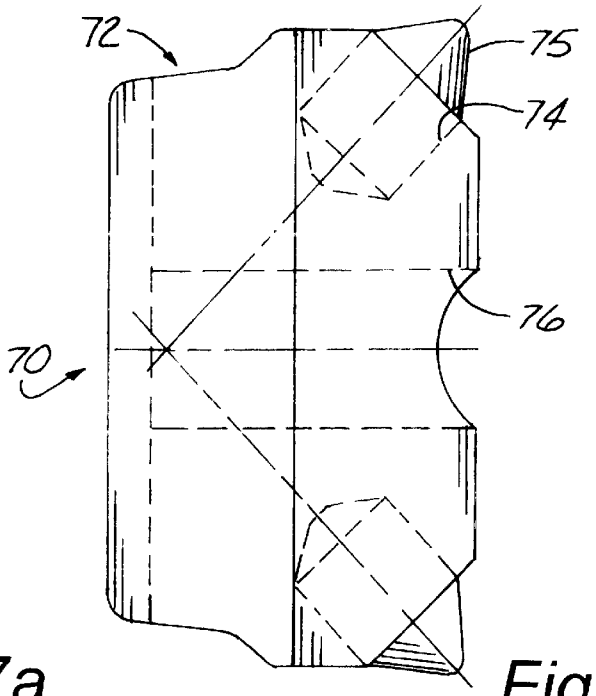
FIG. 7*b* is a side view of the insert of FIG. 7*a* with the tips included.
Figure 7A:
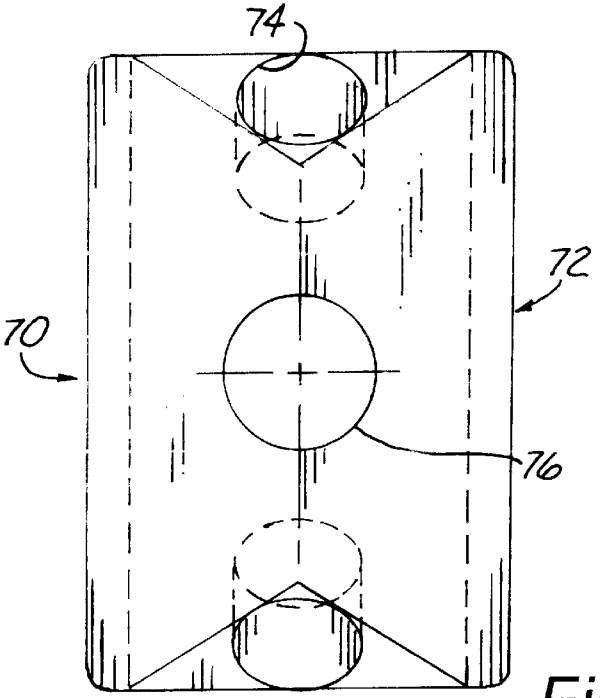
FIG. 7*a* is a top view of an insert with the tips removed.
Figure 7C:
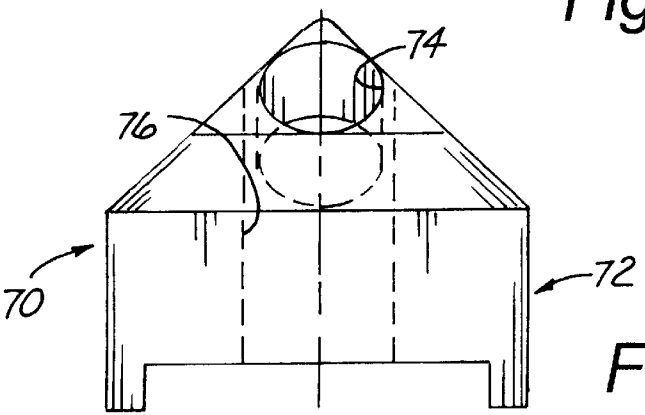
FIG. 7*c* is an end view of the insert of FIG. 7*a*.

FIGS. 7*a–c* show an insert 70 that includes a body 72. The insert 70 also includes distally, and centrally located tip holes 74 for insertion of bullet tips 75 (see FIG. 7*b*), inserted in the manner described above. The insert 70 also include a bolt hole 76 to allow for the insertion of a bolt (not shown) to mount the insert 70 to a hammer (not shown). The insert 70 differs from the inserts shown above in that the bolt hole 76 is threaded to receive the opposite end of the bolt. For example, FIG. 3*a* shows an insert 30 with a bolt hole 36 that is enlarged to receive the hexagonal head of a bolt (not shown). The bolt hole 76 or the inert 70 does not receive the bolt head, but the opposite end of the bolt. Centrally located tip holes 74 may not leave sufficient room to permit a bolt hole wide enough to accommodate the recess for the bolt head, without compromising the structural integrity of the insert 70. The solution comprises inserting the bolt in the opposite direction and using a threaded bolt hole 76 to capture the bolt. This eliminates the need for a nut, and allows for the smallest possible bolt hole 76.

Figure 8B:
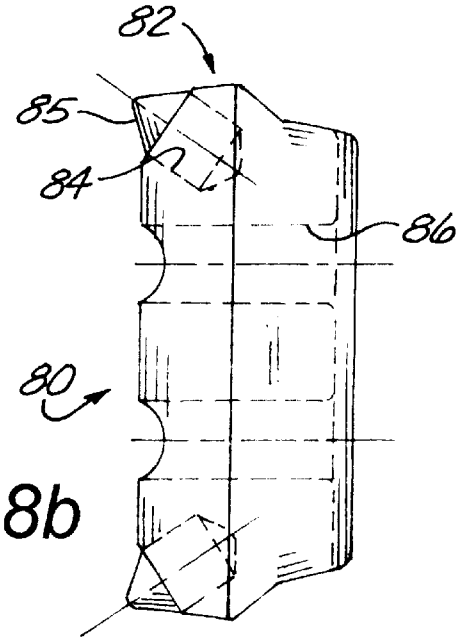
FIG. 8*b* is a side view of the insert of FIG. 8*a* with the tips included.
Figure 8A:
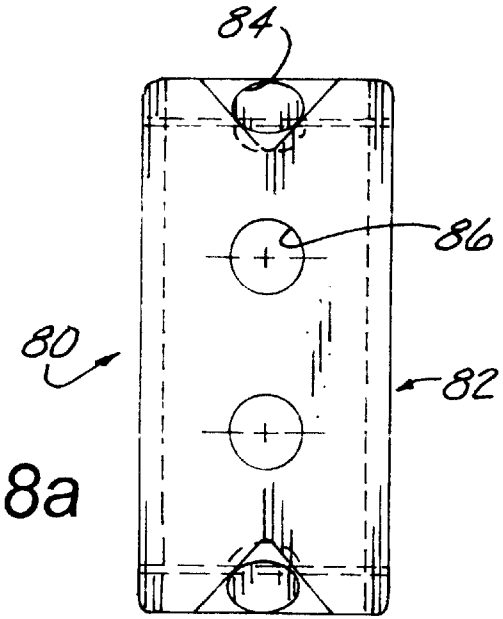
FIG. 8*a* is a top view of an insert with the tips removed.
Figure 8C:
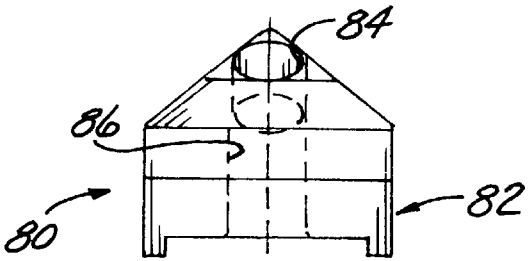
FIG. 8*c* is an end view of the insert of FIG. 8*a*.

FIGS. 8*a–c* show an insert 80 that includes a body 82. The insert 80 also includes distally, and centrally located tip-holes 84 for insertion of bullet tips 85 (see FIG. 8*b*), in the manner described above. The insert 80 also includes two threaded bolt holes 86 to allow for a bolt (not shown) to mount the insert 80 to a hammer (not shown). The insert 80 differs from the insert 70 in that it includes two bolt holes 86, rather than one bolt hole 76. However, the bolt affixes in the manner described for the insert 70.

The present invention combines the advantages of the bullet tip and traditional bolt-on inserts. The present invention allows for use of both type of inserts with one hammer design, which allows for quick and flexible configuration of a size reducing machine for a much wider variety of applications. For example, the size reducing machine can be converted to, or from, a bullet tip insert without changing the hammers. Furthermore, the design of the present invention provides two or more bullet tips on a single insert. This allows for rotating the insert after one of the tips is worn, thereby essentially doubling the useful life of the insert. Also, the present invention provides for a more secure means of attachment, the bullet tip inserts to a hammer, than prior art designs. Use of the bolt-on insert body greatly increases the amount of surface area used for securing the insert to the hammer. This is especially true in consideration of the fact that the insert of the present invention can take advantage of the Saddle-Back Hammer Tip design disclosed in U.S. patent application Ser. No. 09/326,209 filed on Jun. 4, 1999, incorporated herein by reference.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

We claim:

1. An insert for attachment to a hammer of a size reducing machine for use in size reducing waste material, said insert comprising:

a body with a centrally located hole to allow for securement of said hammer insert to a hammer; and two bullet shaped tips distally located on opposite ends of said body, said tips capable of size reducing waste material upon impact.

2. The invention in accordance with claim 1 wherein at least one of said bullet shaped tips is located on said body off center.

3. The invention in accordance with claim 1 wherein said body further comprises distally located tip holes for receipt and securement of said bullet shaped tips.

4. The invention in accordance with claim 3 wherein said bullet shaped tips are secured to said body with weldments.

5. The invention in accordance with claim 1 wherein said body is substantially rectangular in shape.

6. The invention in accordance with claim 1 wherein the bullet shaped tips are centrally located in relation to said body, and said hole in said body is threaded for receipt of a threaded end of a bolt.

7. An insert for attachment to a hammer of a size reducing machine for use in size reducing waste material, said insert comprising:

a body with a centrally located hole to allow for securement of said hammer insert to a hammer, and a first end located opposite to a second end;

a first bullet shaped tip distally located and centered on said first end of said body;

a second and third bullet shaped tip distally located on opposite sides of said second end of said body; and wherein said body comprises a first, second, and third tip holes for receipt and securement of said first, second, and third bullet shaped tips, and said bullet shaped tips are secured to said body with weldments.

8. An insert for attachment to a hammer of a size reducing machine for use in size reducing waste material, said insert comprising:

a body with a centrally located hole to allow for securement of said hammer insert to a hammer; and two bullet shaped tips distally located on said body off center and on the same end of said body, said tips capable of size reducing waste material upon impact.

* * * * *